US010494797B2

(12) United States Patent
Matossian

(10) Patent No.: US 10,494,797 B2
(45) Date of Patent: Dec. 3, 2019

(54) SHOWER CONTROL ASSEMBLY

(71) Applicant: Armand Matossian, Irving, CA (US)

(72) Inventor: Armand Matossian, Irving, CA (US)

( * ) Notice: Subject to any disclaimer, the term of this patent is extended or adjusted under 35 U.S.C. 154(b) by 177 days.

(21) Appl. No.: 15/671,566

(22) Filed: Aug. 8, 2017

(65) Prior Publication Data

US 2019/0048566 A1 Feb. 14, 2019

(51) Int. Cl.
*E03C 1/04* (2006.01)

(52) U.S. Cl.
CPC ..... *E03C 1/0409* (2013.01); *E03C 1/0408* (2013.01); *E03C 1/0412* (2013.01); *Y10T 137/698* (2015.04); *Y10T 137/6977* (2015.04)

(58) Field of Classification Search
CPC ..... E03C 1/0409; E03C 1/0412; E03C 1/057; Y10T 137/6977; Y10T 137/698
See application file for complete search history.

(56) References Cited

U.S. PATENT DOCUMENTS 3,385,116 A 5/1968 Carlson
4,350,322 A * 9/1982 Mueller ..... F16K 31/502 137/556
5,944,255 A 8/1999 Shirmohamadi
6,446,660 B1 * 9/2002 Goni Usabiaga ..... F16K 1/04 137/243.6
6,484,949 B2 11/2002 Proctor
7,191,476 B1 3/2007 Ko
7,240,850 B2 * 7/2007 Beck ..... G05D 23/1346 137/625.4
7,631,655 B1 * 12/2009 Kopp ..... E03C 1/04 137/15.18
D652,897 S 1/2012 Slothower et al.
2006/0243330 A1 11/2006 Abanto
2014/0252257 A1 * 9/2014 Marotz ..... F16K 31/602 251/231

* cited by examiner

*Primary Examiner* — Kevin F Murphy
*Assistant Examiner* — Patrick C Williams

(57) ABSTRACT

A shower control assembly for adjusting a temperature of water in a shower includes a base that is coupled to a wall in a shower thereby facilitating the base to be aligned with a valve that is coupled to the wall. A cover is rotatably coupled to the base and the cover is in mechanical communication with the valve. The cover is manipulated thereby facilitating the valve to be adjusted between a cold position and a hot position. A knob is rotatably coupled to the cover and the knob is in mechanical communication with the valve. The knob finely adjusts the valve between the cold position and the hot position.

16 Claims, 5 Drawing Sheets

SHOWER CONTROL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to control devices and more particularly pertains to a new control device for adjusting a temperature of water in a shower.

BRIEF SUMMARY OF THE INVENTION

An embodiment of the disclosure meets the needs presented above by generally comprising a base that is coupled to a wall in a shower thereby facilitating the base to be aligned with a valve that is coupled to the wall. A cover is rotatably coupled to the base and the cover is in mechanical communication with the valve. The cover is manipulated thereby facilitating the valve to be adjusted between a cold position and a hot position. A knob is rotatably coupled to the cover and the knob is in mechanical communication with the valve. The knob finely adjusts the valve between the cold position and the hot position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
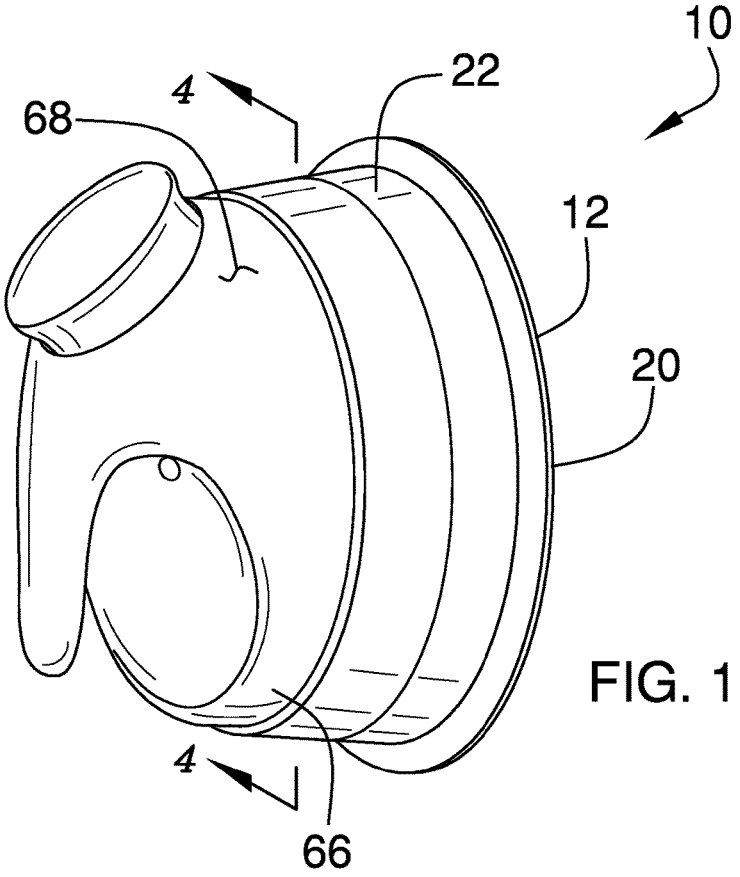
FIG. 1 is a front perspective view of a shower control assembly according to an embodiment of the disclosure.
Figure 2:
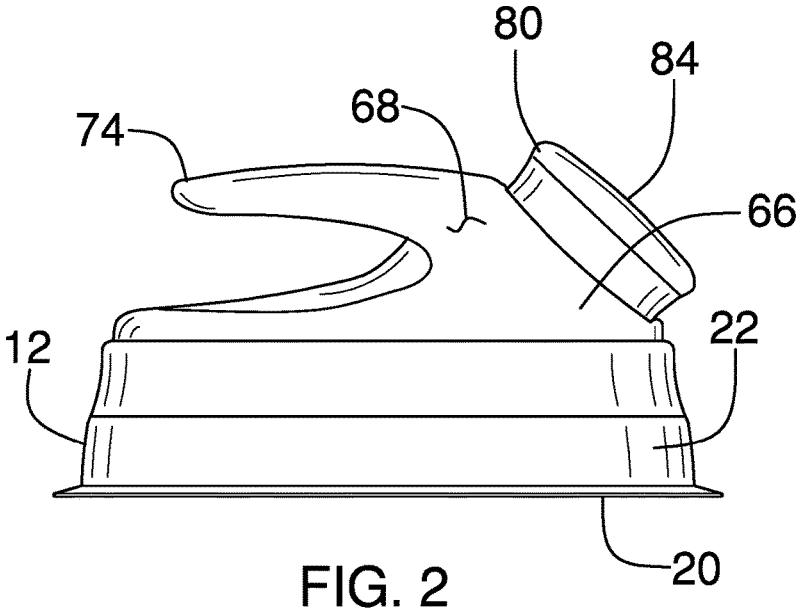
FIG. 2 is a right side view of an embodiment of the disclosure.
Figure 3:
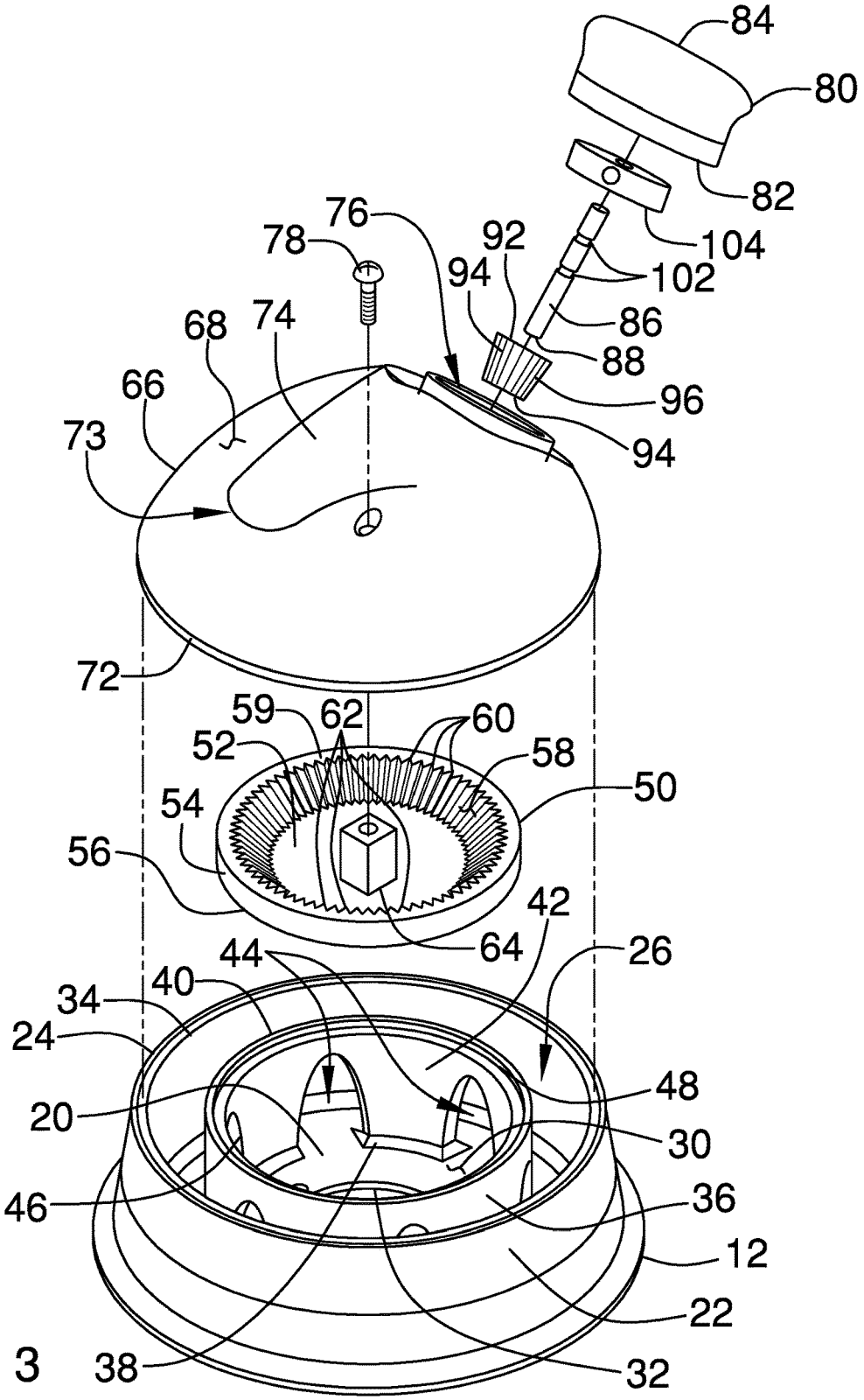
FIG. 3 is an exploded perspective view of an embodiment of the disclosure.
Figure 4:
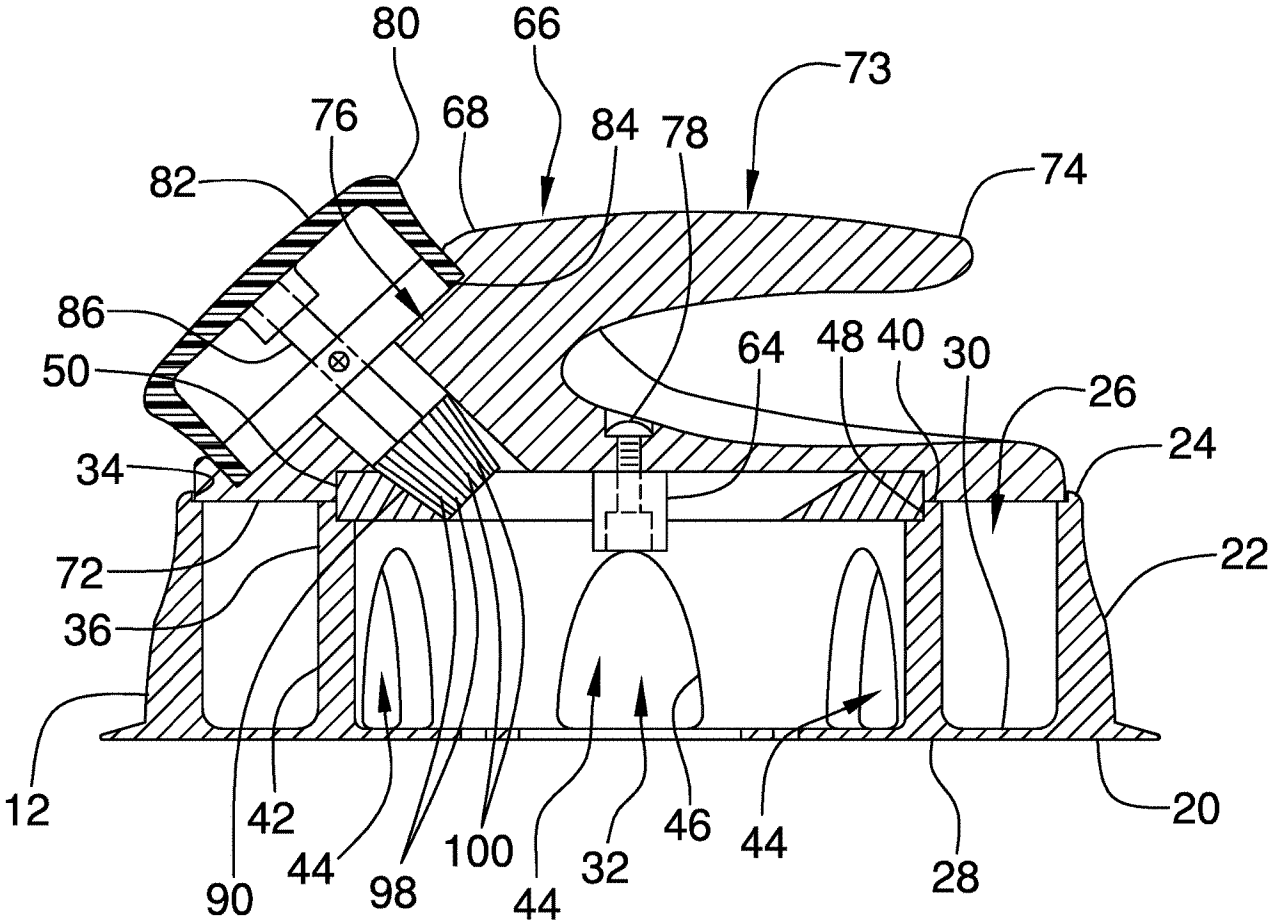
FIG. 4 is a cross sectional view taken along line 4-4 of FIG. 1 of an embodiment of the disclosure.

With reference now to the drawings, and in particular to FIGS. 1 through 6 thereof, a new control device embodying the principles and concepts of an embodiment of the disclosure and generally designated by the reference numeral 10 will be described.

As best illustrated in FIGS. 1 through 6, the shower control assembly 10 generally comprises a base 12 that is coupled to a wall 14 in a shower 16 for bathing. The base 12 is aligned with a valve 18 that is coupled to the wall 14. The valve 18 may be a water valve or the like and the valve 18 may be fluidly coupled to a plurality of fluid sources such as a hot water line and a cold water line. Moreover, the valve 18 is selectively adjusted between a hot position and a cold position. In this way the valve 18 adjusts a temperature of water released from the shower 16 for bathing.

The base 12 has a basal wall 20 and a perimeter wall 22 extending away therefrom and the perimeter wall 22 is continuous such that the base 12 has a cylindrical shape. The perimeter wall 22 has a distal edge 24 with respect to the basal wall 20 to define an opening 26 into the base 12. The basal wall 20 has a first surface 28 and a second surface 30 and the perimeter wall 22 is positioned on the second surface 30. The basal wall 20 has a first aperture 32 extending through the first 28 and second 30 surfaces and the first aperture 32 is centrally positioned on the basal wall 20. The first surface 28 abuts the wall 14 in the shower 16 having the valve 18 extending through the first aperture 32. The distal edge 24 has a first groove 34 extending toward the basal wall 20 and the first groove 34 is coextensive with the distal edge 24.

A sleeve 36 is coupled to the base 12 and the sleeve 36 has a first edge 38, a second edge 40 and a first sleeve wall 42 extending therebetween. The first edge 38 is coupled to the second surface 30 of the basal wall 20 having the sleeve 36 surrounding the first aperture 32 in the base 12. The first sleeve wall 42 has a plurality of openings 44 extending therethrough and the openings 44 are spaced apart from each other and are distributed around the sleeve 36. Each of the openings 44 extends from the first edge 38 toward the second edge 40 and each of the openings 44 has a bounding edge 46. Moreover, the bounding edge 46 corresponding to each of the openings 44 is curved such that each of the openings 44 defines a parabolic segment with the second surface 30 of the base 12. The second edge 40 has a second groove 48 extending toward the first edge 38 and the second groove 48 is coextensive with the second edge 40.

A first gear 50 is rotatably positioned in the base 12 and the first gear 50 is mechanically coupled to the valve 18. The first gear 50 selectively manipulates the valve 18 between the cold position and the hot position. The first gear 50 has a first gear wall 52 and a second gear wall 54 extending away therefrom. The second gear wall 54 is continuous and is aligned with an outward edge 56 of the first sleeve wall 42. Additionally, the second gear wall 54 is positioned in the second groove 48 in the sleeve 36 such that the first gear 50 is rotatable in the second groove 48.

The second gear wall 54 has an inwardly facing surface 58 and a distal edge 59 with respect to the first sleeve wall 42. The inwardly facing surface 58 slopes inwardly between the distal edge 59 and the first surface 28 of the first gear 50. Additionally, the inwardly facing surface 58 has a plurality of first indentations 60 extending therein to define a plurality of first teeth 62. The first teeth 62 are spaced apart from each other and are distributed around the inwardly facing surface 58. A stem 64 is coupled to and extends away from the first surface 28 of the first gear 50 and the stem 64 is centrally positioned on the first surface 28. The stem 64 engages the valve 18 thereby facilitating the first gear 50 to selectively rotate the valve 18.

A cover 66 is rotatably coupled to the base 12 and the cover 66 is selectively manipulated. The cover 66 is in mechanical communication with the valve 18 thereby facilitating the valve 18 to be adjusted between the cold position and the hot position. The cover 66 has a primary surface 68 and a peripheral edge 72 and the primary 68 convexly arcuate such that the cover 66 has a dome shape.

The primary surface 68 has an elongated portion 73 extending away from the cover 66 to define a handle 74 on the cover 66 for gripping. The cover 66 has a second aperture 76 extending therethrough and the second aperture 76 is positioned between the handle 74 and the peripheral edge 72. Additionally, the peripheral edge 72 is positioned in the first groove 34 in the base 12 such that the cover 66 is rotatable in the first groove 34. A fastener 78 extends through the cover 66 and the stem 64. The fastener 78 engages the valve 18 thereby facilitating the cover 66 to rotate the valve 18 when the cover 66 is manipulated. The fastener 78 may be a screw or the like.

A knob 80 is rotatably coupled to the cover 66 and the knob 80 is selectively manipulated. The knob 80 is in mechanical communication with the valve 18 thereby facilitating the knob 80 to finely adjust the valve 18 between the cold position and the hot position. In this way the knob 80 facilitates minute temperature adjustments to be made with respect to the water released from the shower 16. The knob 80 has a first end 82 and a second end 84 and the knob 80 is rotatably positioned in the second aperture 76 in the cover 66.

A shaft 86 is coupled to the first end 82 of the knob 80 and the shaft 86 has a distal end 88 with respect to the knob 80. The shaft 86 extends through the first aperture 32 in the cover 66 and the shaft 86 is oriented at an angle that corresponds to the angle of the inwardly facing surface 58 of the first gear 50. A second gear 90 is provided that has a first end 92, a second end 94 and an outer wall 96 extending therebetween. The outer wall 96 of the second gear 90 slopes inwardly between the first end 92 and the second end 94 of the second gear 90. The outer wall 96 has a plurality of second indentations 98 extending inwardly therein to define a plurality of second teeth 100. The second teeth 100 are spaced apart from each other and are distributed around the second gear 90.

Figure 5:
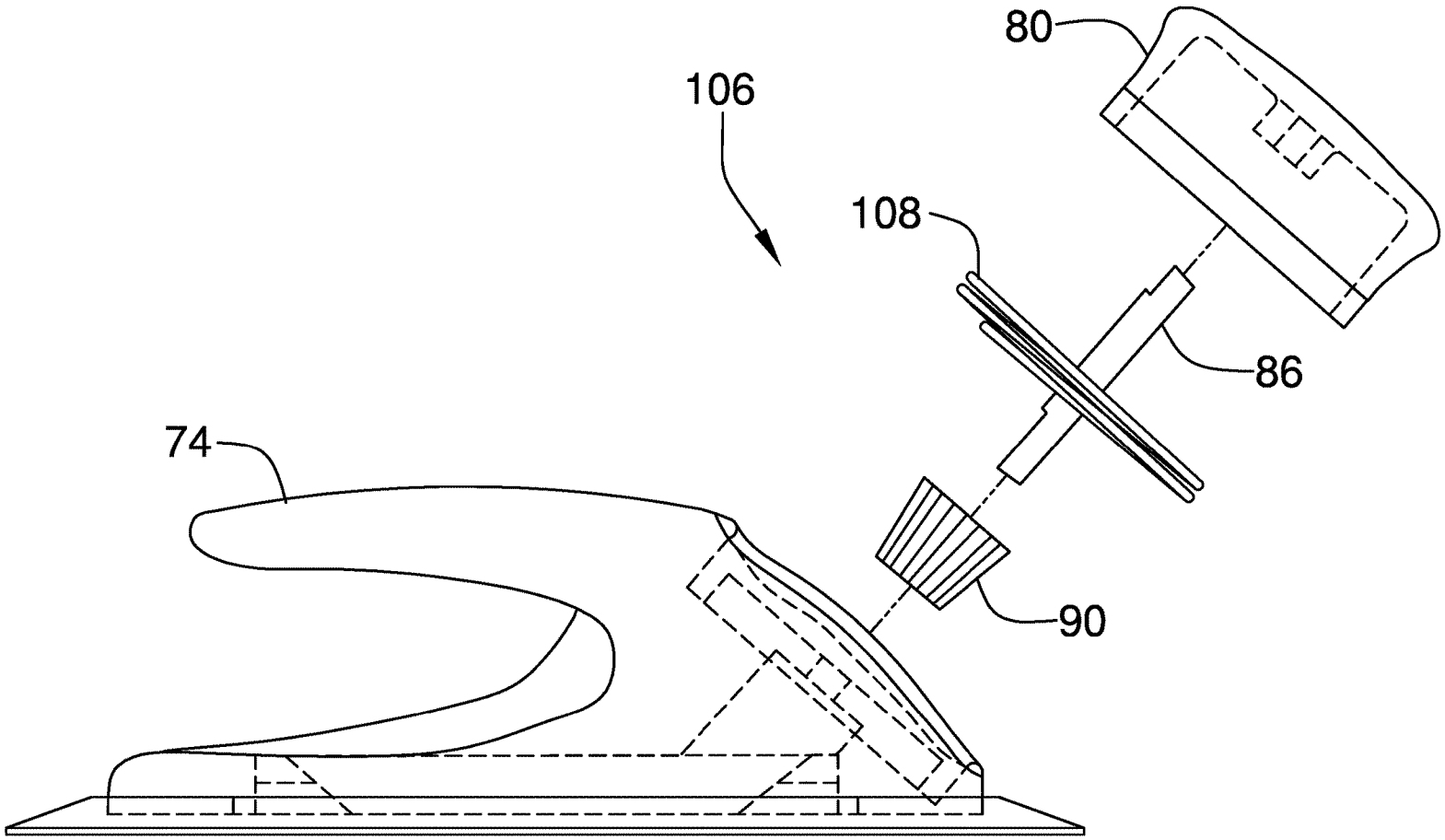
FIG. 5 is an exploded view of an alternative embodiment of the disclosure.
Figure 6:
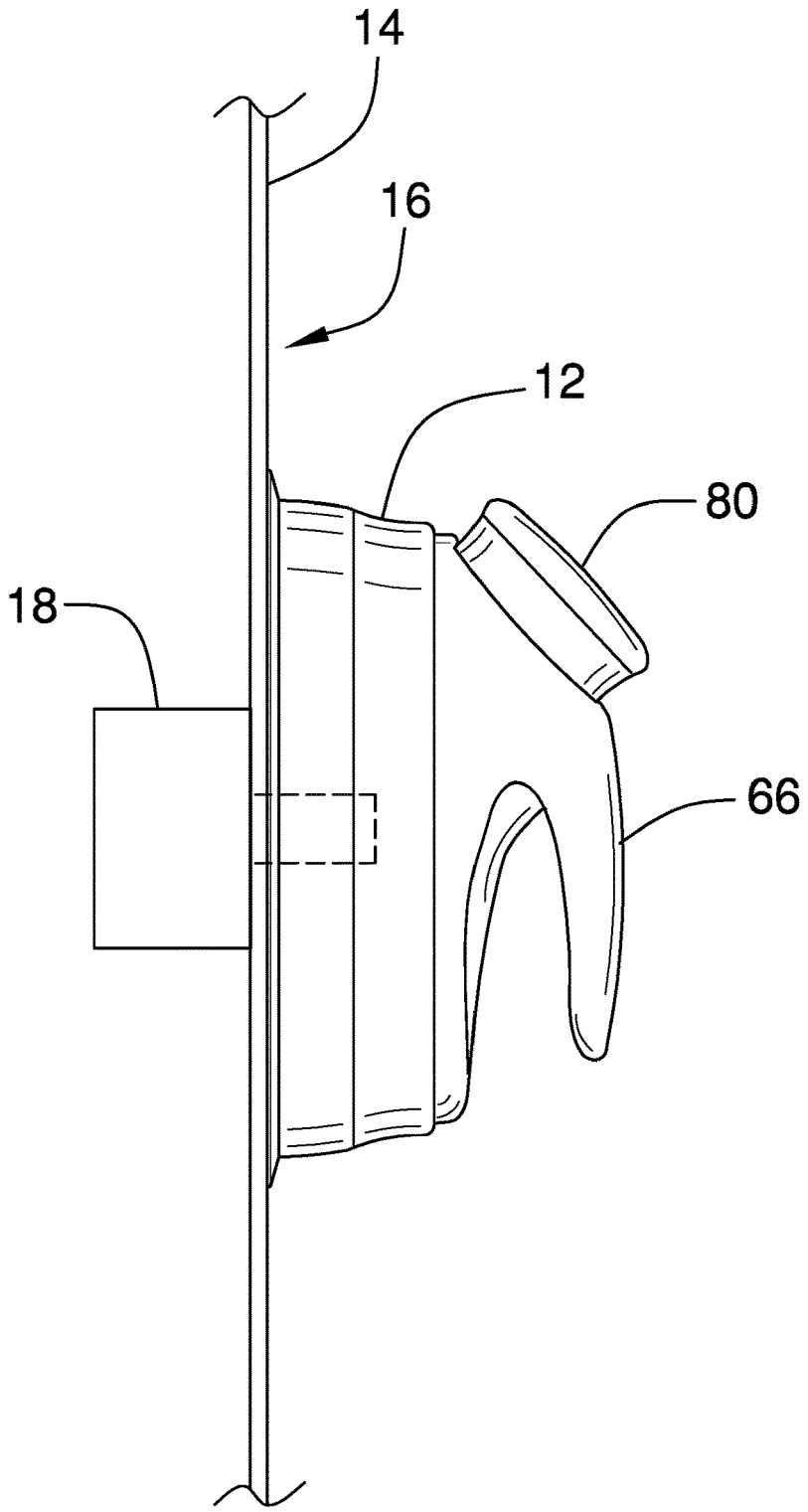
FIG. 6 is a phantom in-use view of an embodiment of the disclosure.

The first end 92 of the second gear 90 is coupled to the distal end 88 of the shaft 86. The second teeth 100 engage the first teeth 62. In this way the first gear 50 is rotated about an axis extending through the stem 64 and the first wall 42 when the knob 80 is rotated. Thus, the knob 80 manipulates the valve 18 between the cold position and the hot position. The shaft 86 may have a pair of detents 102 and a coupler 104 may engage a selected one of the detents 102. In this way the shaft 86 may be retained in the knob 80. In an alternative embodiment 106 as shown in FIG. 5, a biasing member 108 may be positioned around the shaft 86 and the sleeve 36 may be absent from the base 12. The first gear 50 may rest on the basal wall 20 of the base 12 in the alternative embodiment 106.

In use, the handle 74 on the cover 66 is gripped and manipulated to rotate the cover 66 on the base 12. In this way the cover 66 turns the valve 18 in the shower 18 on and off. Additionally, the handle 74 is manipulated to position the valve 18 at a selected point between the cold position and the hot position. The knob 80 is selectively manipulated to finely manipulate the valve 18 between the hot and cold positions. In this way the knob 80 facilitates a degree of temperature control that would otherwise be difficult to achieve with the handle 74. The handle 74 is manipulated to turn the valve 18 off when bathing in the shower 16 is complete.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shower control assembly being configured to facilitate fine temperature control of a shower, said assembly comprising:

a base being configured to be coupled to a wall in a shower thereby facilitating said base to be aligned with a valve being coupled to the wall, said base having a first groove;

a cover being rotatably coupled to said base wherein said cover is configured to be manipulated, said cover being configured to be in mechanical communication with the valve thereby facilitating the valve to be adjusted between the cold position and the hot position, said cover having a primary surface and a peripheral edge extending therebetween, said primary surface being convexly arcuate such that said cover has a dome shape, said primary surface having an elongated portion extending away from said cover to define a handle on said cover for gripping, said cover having a first aperture and a second aperture extending therethrough, said second aperture being positioned between said handle and said peripheral edge, said peripheral edge being positioned in said first groove in said base such that said cover is rotatable in said first groove; and a knob being rotatably coupled to said cover wherein said knob is configured to be manipulated, said knob being configured to be in mechanical communication with the valve thereby facilitating said knob to adjust the valve between the cold position and the hot position such that an amount of rotation of said knob adjusts a position of the valve less than a same amount of rotation of said cover.

2. The assembly according to claim 1, wherein said base has a basal wall and a perimeter wall extending away therefrom, said perimeter wall being continuous such that said base has a cylindrical shape, said perimeter wall having a distal edge with respect to said basal wall to define an opening into said base, said basal wall having a first surface and a second surface, said perimeter wall being positioned on said second surface.

3. The assembly according to claim 2, wherein said basal wall has said first aperture extending through said first and second surfaces, said first aperture being centrally positioned on said basal wall, said first surface being configured to abut the wall in the shower having the valve extending through said first aperture.

4. The assembly according to claim 3, further comprising a sleeve being coupled to said base, said sleeve having a first edge, a second edge and a first sleeve wall extending therebetween, said first edge being coupled to said second surface of said basal wall having said sleeve surrounding said first aperture in said base.

5. The assembly according to claim 4, wherein said second edge has a second groove extending toward said first edge, said second groove being coextensive with said second edge.

6. The assembly according to claim 2, wherein said first groove of said base is in said distal edge extending toward said basal wall, said first groove being coextensive with said distal edge.

7. The assembly according to claim 1, wherein said knob has a first end and a second end, said knob being rotatably positioned in said second aperture in said cover.

8. The assembly according to claim 7, further comprising a shaft being coupled to said first end of knob, said shaft having a distal end with respect to said knob, said shaft extending through said second aperture in said cover.

9. The assembly according to claim 8, further comprising a second gear having a first end, a second end and an outer wall extending therebetween, said first end of said second gear being coupled to said distal end of said shaft.

10. The assembly according to claim 9, wherein said outer wall of said second gear slopes inwardly between said first end and said second end of said second gear, said outer wall having a plurality of second indentations extending inwardly therein to define a plurality of second teeth, said second teeth being spaced apart from each other and being distributed around said second gear.

11. The assembly according to claim 10, further comprising:

a first gear having a plurality of first teeth and a first wall;

a stem being coupled to said first wall; and said second teeth engaging said first teeth such that said first gear is rotated about an axis extending through said stem and said first wall when said knob is rotated wherein said knob is configured to manipulate the valve between the cold position and the hot position.

12. A shower control assembly being configured to facilitate fine temperature control of a shower, said assembly comprising:

a base being configured to be coupled to a wall in a shower thereby facilitating said base to be aligned with a valve being coupled to the wall, said base having a basal wall and a perimeter wall extending away therefrom, said perimeter wall being continuous such that said base has a cylindrical shape, said perimeter wall having a distal edge with respect to said basal wall to define an opening into said base, said basal wall having a first surface and a second surface, said perimeter wall being positioned on said second surface, said basal wall having a first aperture extending through said first and second surfaces, said first aperture being centrally positioned on said basal wall, said first surface being configured to abut the wall in the shower having the valve extending through said first aperture;

a cover being rotatably coupled to said base wherein said cover is configured to be manipulated, said cover being configured to be in mechanical communication with the valve thereby facilitating the valve to be adjusted between the cold position and the hot position;

a knob being rotatably coupled to said cover wherein said knob is configured to be manipulated, said knob being configured to be in mechanical communication with the valve thereby facilitating said knob to adjust the valve between the cold position and the hot position such that an amount of rotation of said knob adjusts a position of the valve less than a same amount of rotation of said cover;

a sleeve being coupled to said base, said sleeve having a first edge, a second edge and a first sleeve wall extending therebetween, said first edge being coupled to said second surface of said basal wall having said sleeve surrounding said first aperture in said base; and wherein said first sleeve wall has a plurality of openings extending therethrough, said openings being spaced apart from each other and being distributed around said sleeve, each of said openings extending from said first edge toward said second end, each of said openings having a bounding edge, said bounding edge corresponding to each of said openings being curved such that each of said openings defines a parabolic segment with said second surface of said base.

13. The assembly according to claim 12, further comprising: said distal edge having a first groove extending toward said basal wall, said first groove being coextensive with said distal edge;

said second edge having a second groove extending toward said first edge, said second groove being coextensive with said second edge;

a first gear being rotatably positioned in said base wherein said first gear is configured to be mechanically coupled to the valve thereby facilitating said first gear to selectively manipulate the valve between a cold position and a hot position, said first gear having a first gear wall and a second gear wall extending away therefrom, said second gear wall being continuous and being aligned with an outward edge of said first gear wall, said second gear wall being positioned in said second groove in said sleeve such that said first gear is rotatable in said second groove, said second gear wall having an inwardly facing surface and a distal edge with respect to said first gear wall, said inwardly facing surface sloping inwardly between said distal edge and said first surface of said first gear, said inwardly facing surface having a plurality of first indentations extending therein to define a plurality of first teeth, said plurality of first teeth being spaced apart from each other and being distributed around said inwardly facing surface, said;

a stem being coupled to and extending away from said first surface of said first gear, said stem being centrally positioned on said first surface, said stem being configured to engage the valve thereby facilitating said first gear to selectively rotate the valve;

said cover having a primary surface and a peripheral edge extending therebetween, said primary surface being convexly arcuate such that said cover has a dome shape, said primary surface having an elongated portion extending away from said cover to define a handle on said cover for gripping, said cover having a second aperture extending therethrough, said second aperture being positioned between said handle and said peripheral edge, said peripheral edge being positioned in said first groove in said base such that said cover is rotatable in said first groove;

a fastener extending through said cover and said stem wherein said fastener is configured to engage the valve thereby facilitating said cover to rotate the valve when said cover is manipulated;

said knob having a first end and a second end, said knob being rotatably positioned in said second aperture in said cover;

a shaft being coupled to said first end of said knob, said shaft having a distal end with respect to said knob, said shaft extending through said first aperture in said cover; and a second gear having a first end, a second end and an outer wall extending therebetween, said outer wall of said second gear sloping inwardly between said first end and said second end of said second gear, said outer wall having a plurality of second indentations extending inwardly therein to define a plurality of second teeth, said second teeth being spaced apart from each other and being distributed around said second gear, said first end of said second gear being coupled to said distal end of said shaft, said second teeth engaging said first teeth such that said first gear is rotated about an axis extending through said stem and said first gear wall when said knob is rotated wherein said knob is configured to manipulate the valve between the cold position and the hot position.

14. A shower control assembly being configured to facilitate fine temperature control of a shower, said assembly comprising:

a base being configured to be coupled to a wall in a shower thereby facilitating said base to be aligned with a valve being coupled to the wall, said base having a basal wall and a perimeter wall extending away therefrom, said perimeter wall being continuous such that said base has a cylindrical shape, said perimeter wall having a distal edge with respect to said basal wall to define an opening into said base, said basal wall having a first surface and a second surface, said perimeter wall being positioned on said second surface, said basal wall having a first aperture extending through said first and second surfaces, said first aperture being centrally positioned on said basal wall, said first surface being configured to abut the wall in the shower having the valve extending through said first aperture;

a cover being rotatably coupled to said base wherein said cover is configured to be manipulated, said cover being configured to be in mechanical communication with the valve thereby facilitating the valve to be adjusted between the cold position and the hot position;

a knob being rotatably coupled to said cover wherein said knob is configured to be manipulated, said knob being configured to be in mechanical communication with the valve thereby facilitating said knob to adjust the valve between the cold position and the hot position such that an amount of rotation of said knob adjusts a position of the valve less than a same amount of rotation of said cover;

a sleeve being coupled to said base, said sleeve having a first edge, a second edge and a first sleeve wall extending therebetween, said first edge being coupled to said second surface of said basal wall having said sleeve surrounding said first aperture in said base;

a first gear being rotatably positioned in said base wherein said first gear is configured to be mechanically coupled to the valve thereby facilitating said first gear to selectively manipulate the valve between a cold position and a hot position, said first gear having a first gear wall and a second gear wall extending away therefrom, said second gear wall being continuous and being aligned with an outward edge of said first sleeve wall, said second gear wall being positioned in said second groove in said sleeve such that said first gear is rotatable in said second groove; and said second gear wall having an inwardly facing surface and a distal edge with respect to said first sleeve wall, said inwardly facing surface sloping inwardly between said distal edge and said first surface of said first gear, said inwardly facing surface having a plurality of first indentations extending therein to define a plurality of first teeth, said plurality of first teeth being spaced apart from each other and being distributed around said inwardly facing surface.

15. The assembly according to claim 14, further comprising a stem being coupled to and extending away from said first surface of said first gear, said stem being centrally positioned on said first surface, said stem being configured to engage the valve thereby facilitating said first gear to selectively rotate the valve.

16. The assembly according to claim 15, further comprising a fastener extending through said cover and said stem wherein said fastener is configured to engage the valve thereby facilitating said cover to rotate the valve when said cover is manipulated.

* * * * *